United States Patent [19]

Rose

[11] 4,173,881

[45] Nov. 13, 1979

[54] ROLLING STAND WITH HYDRAULIC ADJUSTMENT OF THE MILL ROLLS

[75] Inventor: Heinrich Rose, Kreuztal, Fed. Rep. of Germany

[73] Assignee: Schloemann-Siemag AG, Dusseldorf, Fed. Rep. of Germany

[21] Appl. No.: 914,144

[22] Filed: Jun. 9, 1978

[30] Foreign Application Priority Data

Jun. 10, 1977 [DE] Fed. Rep. of Germany ..... 2726140

[51] Int. Cl.[2] ..... B21B 31/32

[52] U.S. Cl. ..... 72/245; 92/167; 92/127; 277/71; 277/3; 277/110; 277/188 A

[58] Field of Search ..... 72/245, 237; 92/167, 92/127; 277/3, 27

[56] References Cited

U.S. PATENT DOCUMENTS

| | | | |
|---|---|---|---|
| 3,596,490 | 8/1971 | Willeke et al. | 72/245 X |
| 4,007,618 | 2/1977 | Ponter | 72/245 |

*Primary Examiner*—Milton S. Mehr

*Attorney, Agent, or Firm*—Karl F. Ross

[57] ABSTRACT

A rolling stand with hydraulic adjustment of the mill rolls comprises a hydraulic cylinder whose piston is acted upon by the adjustment spindle and whose cylinder body, in turn, bears upon the block in which the back-up or pressure roll is journaled. The sliding seal of the piston rides in a cylinder lining which is disposed in the cylinder and is sealed relative to the latter with stationary O-rings so that pressure equalization on both sides of the liner is possible, thereby preventing expansion of the line upon subjection of the cylinder to high pressures.

9 Claims, 2 Drawing Figures

ROLLING STAND WITH HYDRAULIC ADJUSTMENT OF THE MILL ROLLS

FIELD OF THE INVENTION

The present invention relates to a rolling stand, i.e. a rolling-mill stand, with hydraulic adjustability of the rolls. More particularly, the invention relates to improvements in the hydraulic pressurization or adjustment devices in such rolling mill stands.

BACKGROUND OF THE INVENTION

A rolling mill stand can comprise hydraulic devices for adjusting the rolling gap and the pressure applied by, for example, a back-up roll or support roll to the working roll of such a stand.

In a common construction of such a rolling-mill stand, the adjustment of the gap and rolling pressure is effected by a threaded spindle which acts via the hydraulic piston-and-cylinder arrangement upon the journal block of the pressure or backing roll which, in turn, bears upon the working roll. The hydraulic cylinder is pressurizable with a hydraulic medium and sealing rings or, more generally, a sliding packing or sealing device is provided between the cylinder and piston walls.

Such adjusting cylinders are used for the rapid adjustment of the rolling gap and it is desirable to so construct and arrange the hydraulic adjusting device that it can operate with high adjusting speeds and, especially, can sustain high adjusting accelerations.

The piston-cylinder unit of such a hydraulic adjusting system is generally subjected to extremely high fluid pressures.

Such high fluid pressures have a tendency to expand the cylinders and thereby change the dimensions of the gap between the piston and cylinder.

The sliding packing or seal between the piston and cylinder has generally only a limited capacity to compensate for this change in the gap dimensions. Furthermore, there is always the danger that the change in the gap size between the piston and the cylinder will result in leakage and subject the sliding seal or packing, as a result of these changes in gap dimensions, not only to variable axial stresses, but also to variable radial stresses, thereby reducing the operating life of the packing. A reduction in the useful life of the packing means that the rolling stand can only be operated for limited periods before maintenance operations must be performed and increases the down time of the stand while reducing the duty cycle thereof.

Another result of the tendency for the high pressures to expand the cylinders radially is that the friction effects between the sliding packing and the cylinder wall will change. This is undesirable and creates difficulties in precision adjustment of the rolling gap.

OBJECTS OF THE INVENTION

It is the principal object of the present invention to provide a rolling stand and, especially, a hydraulic adjustment device for such a rolling stand, in which the aforedescribed disadvantages are obviated.

Another object of the invention is to provide, in a rolling stand, a hydraulic device in which the gap bridged by the sliding packing or seal does not change during pressurization or other operating conditions of the hydraulic device.

Yet another object of the invention is to provide an improved hydraulic device for the adjustment of the rolling gap in a rolling-mill stand.

SUMMARY OF THE INVENTION

These objects and others which will become apparent hereinafter are attained, in accordance with the present invention, in a rolling-mill stand in which a hydraulic device is disposed between the rolling-gap adjustment spindle and a roll of the stand and in which the hydraulic device includes a piston and a cylinder, the latter subjected to pressurization at high pressure levels with a hydraulic medium. According to the invention, the cylinder is provided with a liner or cylinder sleeve defining the gap spanned by the sliding packing which is entrained with the piston and disposed in and along the cylinder wall. According to the principles of the invention, the liner or sleeve is immovable in the cylinder and is pressurized by the hydraulic medium on opposite sides so as to preclude distortion upon hydraulic pressurization of the cylinder. Sealing between the cylinder wall and the sleeve can be effected by stationary seals, preferably O-rings.

This arrangement insures that the gap between the piston and the wall juxtaposed therewith and along which the sliding packing moves remains substantially constant. The sliding packing is thus no longer subjected to variations in radial stress.

The O-rings previously mentioned can be provided in annular grooves formed in the cylinder wall or in the cylinder lining or sleeve.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
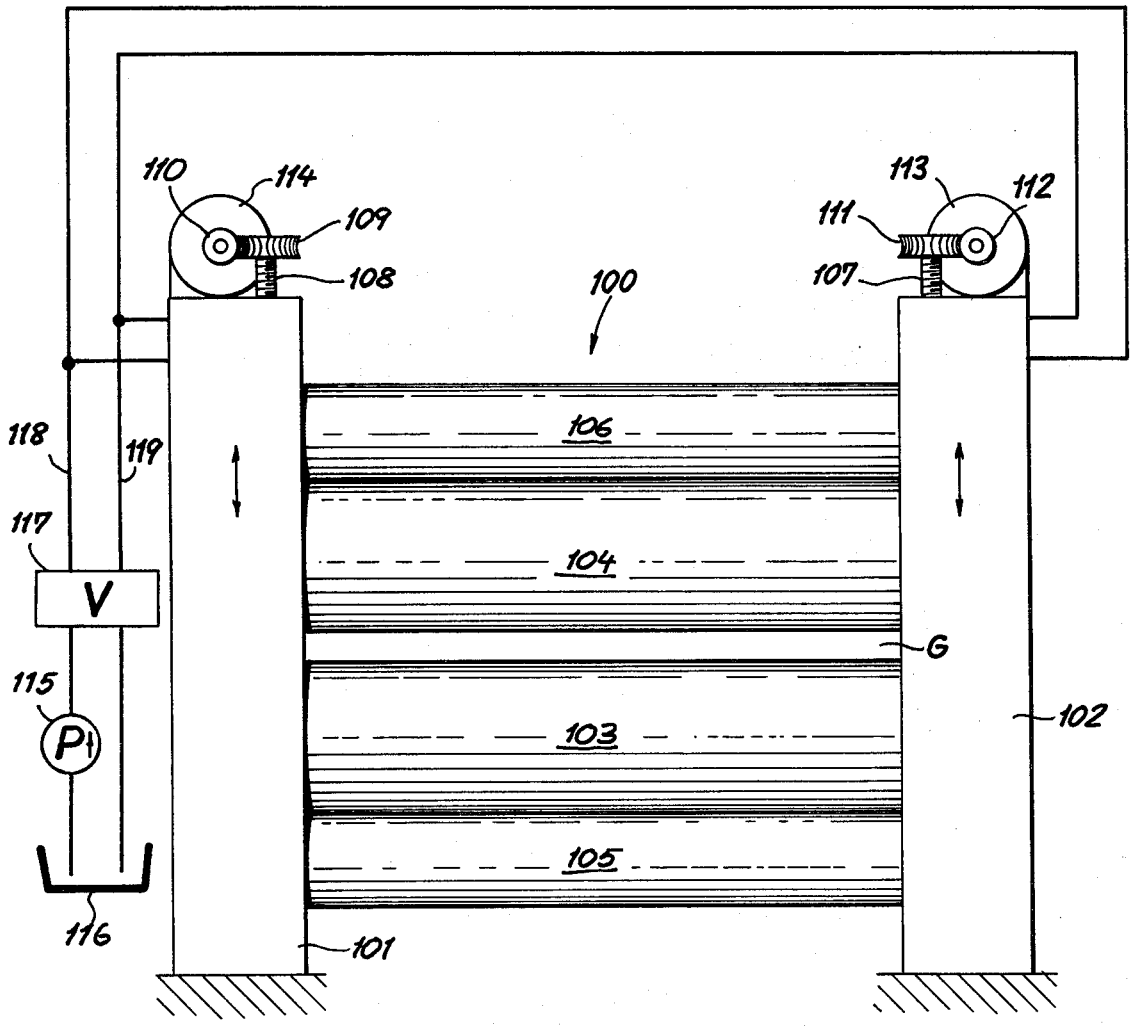
FIG. 2 is a diagram illustrating a rolling stand which can be provided with the device illustrated in FIG. 1.

Referring first to FIG. 2 in which a four-high rolling-mill stand 100 is outlined only in the sketchiest of ways, it will be seen that the basic elements of the rolling-mill stand are the main or working rolls 103 and 104 which define the working gap G between them and which are guided in a pair of supports (housings) 101 and 102 which can be mounted on the usual base, not shown, on the floor of the rolling mill (see The making, Shaping and Treating of Steel, U.S. Steel Co., 1971, pp. 731 ff.). These rolls 103 and 104 can be driven in the usual manner, e.g. via flexible couplings to drive motors, and can be vertically displaceable in the uprights 101 and 102.

It is customary to provide backing rolls 105 and 106 which support the working rolls 103 and 104 and which are capable of adjustment to vary the gap G. The adjusting means can include threaded spindles 107 and 108 which can be rotated in nuts carried by the uprights 101 and 102, but not shown in the drawing, and driven, e.g. by worm wheels 109, 111. The worm wheels are, in turn, rotated by worms 110 and 112 driven by motors 113 and 114 via speed-reducing gearing.

Figure 1:
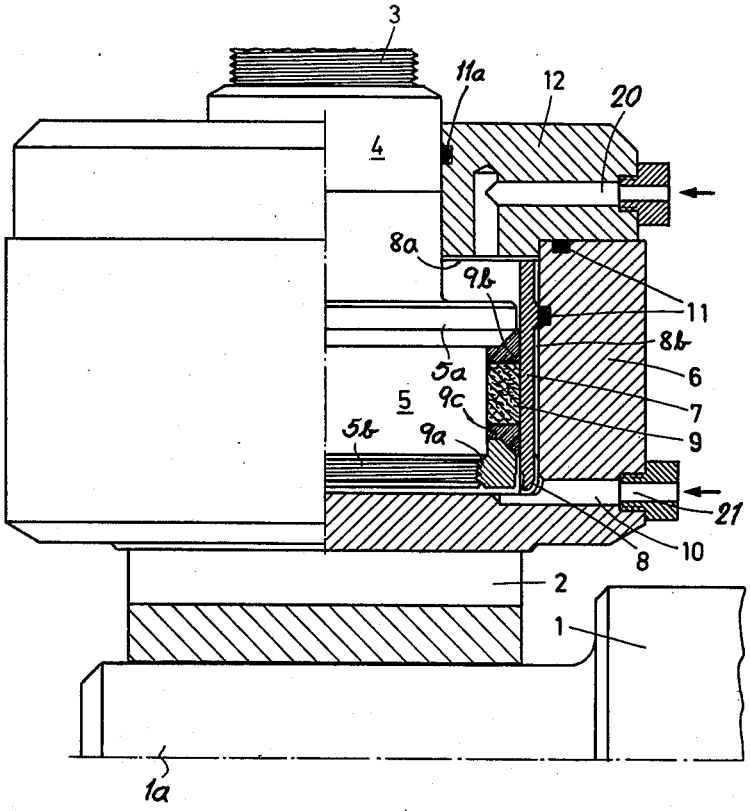
FIG. 1 is a partial cross-sectional view in somewhat diagrammatic form, illustrating a hydraulic adjusting device for a rolling stand according to the invention.

The hydraulic adjusting devices, which can be of the type shown in FIG. 1, are disposed between the spindles 108 and 107 and the back-up or support roll 106 and are supplied with hydraulic fluid under high pressure via the lines 118 and 119 through a valve 117 from a pump 115 which can draw the hydraulic fluid from a reservoir 116.

The hydraulic adjusting device can have the construction shown in FIG. 1 and can act upon the upper support roll 1 which is, of course, equivalent to the roll 106 previously mentioned. The stub shaft 1*a* of this roll 1 is journaled in a bearing block 2 which is vertically guided in the support, e.g. the upright 101 previously mentioned, and abuts the cylinder 6 directly.

The threaded spindle, here shown at 3, bears upon the thrust bearing 4 of a piston 5 slideable in the cylinder 6, the pistons 5 and the cylinder 6 constituting the unit which performs the hydraulic adjustment. This unit is disposed in force transmitting relationship between the spindle 3 and the bearing block 2 of the upper support roll 1.

The cylinder 6 receives the cylinder liner or sleeve 7. Between the piston 5 and the cylinder sleeve or liner 7, there is provided a slide packing or seal 9.

As has been shown in FIG. 1, the seal 9 is fixed for axial movement with the piston 5. To this end, the piston 5 can be formed with a shoulder 5*a* against which a backing ring 9*b* can rest. The packing 9 is clamped against this backing ring 9*b* by a further backing ring 9*c* and a clamping nut 9*a* threaded onto the end 5*b* of the piston 5.

The cylinder liner or sleeve 7 is formed at its lower end with grooves 8 which provide a fluid-communication path between the spaces on both sides of the cylinder liner or sleeve.

Bore 10 is connected to a fitting 21 to deliver the hydraulic medium to the cylinder 6 and a corresponding bore 20 may be provided for fluid communication with the cylinder on the opposite side of the sliding packing or seal.

As a consequence, the liner or sleeve 7 is pressurized both along its inner surface and along its outer surface with the same hydraulic pressure of the medium.

A seal of the pressure compartments relative to one another and against the exterior is effected by stationary O-rings 11 which are received in grooves formed in the cylinder wall. The cylinder 6 is closed at its upper end by a cylinder cover 12 which can be sealed via an O-ring 11*a* against the thrust bearing 4.

A gap 8*a* between the liner 7 and the cylinder cover 12 allows communication between the compartment within the liner above the packing 9 and the space around the liner.

For hydraulic adjustment of the rolls of the stand, cylinder 6 is charged with hydraulic medium via lines 118 and 119 and bores 10 or 20 to relatively displace the pistons and the cylinder. The pressurized medium passes via the grooves 8 and the gap 8*a* to both sides of the liner 7, thereby precluding enlargement or expansion of the liner 7.

While an expansion of the cylinder 6 is possible, the outward movement of the wall of the cylinder 6 relative to the external wall of the liner is readily compensated by the stationary O-rings which, because they do not slide, have long life. Wear of the slide packing or seal 9 is thus significantly reduced by comparison with earlier systems of the type described.

In place of the grooves 9 at the lower edge of the cylinder sleeve or liner 7, the cylinder sleeve or liner can be provided with bores or recesses can be provided in the cylinder 6 to allow pressure equalization on both sides of the liner or sleeve 7.

I claim:

1. The combination in a rolling-mill stand of:

at least one displaceable roll provided with a bearing block and shiftable to adjust a rolling gap of the stand;

at least one spindle rotatable for shifting said roll and in force transmitting relationship therewith; and a hydraulic device disposed between said spindle and said block, said hydraulic device comprising a cylinder pressurizable with a hydraulic medium at an elevated pressure, and a piston slideable in said cylinder, a sliding packing surrounding said piston and displaceable therewith relative to said cylinder, and a cylinder sleeve received within said cylinder and disposed between said packing and the cylinder wall, said sleeve being fixed relative to the cylinder, said device being provided with means for equalizing hydraulic medium pressure between the inner and outer surfaces of said sleeve upon pressurization of said cylinder, said sliding packing engaging said sleeve.

2. The combination defined in claim 1, further comprising at least one O-ring interposed between an outer wall of said sleeve and an inner wall of said cylinder.

3. The combination defined in claim 2 wherein one of the last-mentioned walls is formed with a groove open toward the other of said last-mentioned walls and receiving said O-ring.

4. The combination defined in claim 3 wherein said groove is formed in said inner wall of said cylinder.

5. The combination defined in claim 4, further comprising a cylinder cover closing said cylinder, a further O-ring being disposed between said cylinder and said cylinder cover.

6. The combination defined in claim 5, further comprising a thrust bearing disposed between said spindle and said piston, said cylinder bearing upon said block.

7. The combination defined in claim 6 wherein said piston is provided with a shoulder, said sliding packing being clamped against said shoulder.

8. The combination defined in claim 7 wherein said sliding packing is clamped between a pair of backing rings.

9. The combination defined in claim 8 wherein said stand has a pair of working rolls and an upper backing roll bearing upon an upper one of said working rolls, said cylinder bearing upon a journal block of said backup roll.

* * * * *